US006446962B1

(12) United States Patent
Taffertshofer

(10) Patent No.: US 6,446,962 B1
(45) Date of Patent: Sep. 10, 2002

(54) DEVICE FOR VERTICALLY FORMING PARTIAL STACKS OF PRINTED PRODUCTS

(75) Inventor: Michael Taffertshofer, Weilheim (DE)

(73) Assignee: D.E. Pfaff Ingenieurburo GmbH & Co. KG., Augsburg (DE)

( * ) Notice: Subject to any disclaimer, the term of this patent is extended or adjusted under 35 U.S.C. 154(b) by 0 days.

(21) Appl. No.: 09/669,383

(22) Filed: Sep. 26, 2000

(30) Foreign Application Priority Data

Oct. 1, 1999 (DE) ..... 199 47 329

(51) Int. Cl.[7] ..... B65H 29/20; B65H 29/70

(52) U.S. Cl. ..... 271/312; 271/188; 271/189; 271/209; 271/216; 271/223

(58) Field of Search ..... 271/306, 307, 271/312, 175, 188, 189, 198, 209, 216, 218, 223

(56) References Cited

U.S. PATENT DOCUMENTS

| | | | | |
|---|---|---|---|---|
| 4,183,704 A | | 1/1980 | Rima | |
| 5,042,792 A | * | 8/1991 | Honegger et al. | 271/182 |
| 5,209,466 A | * | 5/1993 | Watts et al. | 271/188 |
| 5,545,001 A | | 8/1996 | Capdeboscq | |
| 5,669,755 A | | 9/1997 | Zahn | |

FOREIGN PATENT DOCUMENTS

| | | | |
|---|---|---|---|
| CH | 552 529 | 8/1974 | |
| DE | 1 215 175 | 4/1966 | |
| DE | 93 17 919 | 5/1994 | |
| DE | 43 44 361 | 9/1994 | |
| DE | 4408780 | 9/1995 | |
| DE | 44 08 780 | 9/1995 | |
| DE | 695 00 305 | 10/1997 | |
| EP | 0 666 234 | 1/1995 | |
| JP | 63-315458 | * 12/1988 | ..... B65H/33/02 |
| JP | 3-288764 | 12/1991 | |

* cited by examiner

*Primary Examiner*—David H. Bollinger
*Assistant Examiner*—Kenneth W Bower
(74) *Attorney, Agent, or Firm*—Dobrusin & Thennisch PC

(57) ABSTRACT

A device for vertically forming partial stacks of printed products. Said device comprises a belt conveyor (1) for transporting printed products, a bulging device (11), by which the printed products conveyed on the belt conveyor (1) may be provided with a convexity around an axis extending in the conveying direction of the belt conveyor (1) vertically extending collecting shaft (2), adjustable in format and disposed at one end of the belt conveyor (1) in the extension thereof, and having an openable stacking support (21) disposed therein, from which a stack of printed products may be picked up, and a first supporting finger (3), disposed on the side of the belt conveyor (1) facing away from the collecting shaft (2) and above the stacking support (21), said finger being displaceable by a displacing device (5) from a starting position, in which it extends centrally into the collecting shaft (2) above the stream of printed products, vertically downwards into said stream of conveyed printed products. The finger operates such that subsequently conveyed printed products are placed on said first supporting finger (3), which is then horizontally displaceable out of the collecting shaft (2) and back into its starting position.

20 Claims, 4 Drawing Sheets

DEVICE FOR VERTICALLY FORMING PARTIAL STACKS OF PRINTED PRODUCTS

CLAIM OF PRIORITY

This application claims priority to and the benefit of the filing date of German Application No. 199 47 329.3-27, filed Oct. 1, 1999, hereby expressly incorporated by reference.

TECHNICAL FIELD

The invention relates to a device, by which printed products conveyed on a conveying belt, in particular in scale-shaped configuration, are vertically stacked and dispensed in partial stacks of a desired number.

BACKGROUND OF THE INVENTION

Printed products are conventionally compiled and packaged in stacks for transport. This requires partial stacks to be formed, each comprising a certain number of printed products. Conventionally, the printed products conveyed, e.g. in a scale-shaped or overlapping configuration, on a belt conveyor are dropped into a vertical collecting shaft. An openable stacking support, on which the stacks are formed, is disposed within said collecting shaft.

In order for such a stacking device to be used in diverse ways and thus to pay off quickly, it is desirable to use a collecting shaft which is adjustable in format.

Once the desired number of printed products for one partial stack has been achieved, the stacking support is opened, and the partial stack thus formed is ejected in downwards. The operation of opening the stacking support, ejecting the partial stack and closing the stacking support again requires a certain time. In order to prevent subsequent printed products from being included in the ejected partial stack or from being stuck in the closing stacking support, the stream of printed products has to be briefly delayed.

DE-U 1-93 17 919 suggests to provide several horizontally displaceable and thus openable and closeable stacking supports shaped like rakes below one another within said collecting shaft. A stack is then formed on a lower stacking support. By closing an upper stacking support, the formation of the stack is concluded. The completed stack is transferred by opening a lower stacking support. Upon closing of the lower stacking support, a new stack may be formed on the lower stacking support by opening the upper stacking support and dropping the printed products meanwhile compiled thereon. This cycle may be further perfected by providing three stacking supports disposed below one another.

That embodiment has the disadvantage that the throughput of printed products thus achieved is limited, to ensure that printed products dropping into said collecting shaft after one another have a certain distance between them, and so that, upon closure of the upper stacking support, the rake may be passed, without any problem, between two printed products consecutively dropping into said collecting shaft.

Although it is contemplated in that embodiment to provide a collecting shaft which is adjustable in format, larger formats increase the risk of the rake not being passed properly between two consecutive printed products. Products of a large format tend to drop into the collecting shaft in a slanted or bulged position. Therefore, even larger gaps must be observed between consecutive printed products in order to exclude malfunctions. The achievable throughput is thus further reduced.

JP-A 2-3-288764 discloses that disruptions may be achieved in a stream of printed products conveyed in scale-like configuration by passing a separating plate, which initially extends into the collecting shaft above the scale stream on the side of the collecting shaft facing away from the belt conveyor, down into the scale-like stream. Those printed products which have already been conveyed completely into the collecting shaft, are pushed down by the separating plate. Subsequent printed products will slide over the separating plate and form a stack thereon. During this movement, the separating occupies the major portion of the cross-section of the collecting shaft. The separating plate is then guided downwards, withdrawn from the collecting shaft in a horizontal direction, while unloading the printed products collected thereon, and then moved back into the starting position.

That embodiment has the disadvantage that it requires a very complicated set-up of equipment. The separating plate has to be guided back to the top on the outside of the collecting shaft over a considerable distance, thus requiring a considerable amount of space. In addition, the movement of the separating plate requires a certain amount of time due to its considerable mass. Thus, a high throughput can be ensured only by providing several separating plates. For a collecting shaft being adjustable in format, the apparatus would be even larger and more complicated.

Accordingly, it is an object of the invention to provide a device for vertically stacking printed products, which is adjustable in format, allows a high throughput without being prone to malfunction, while not requiring a very complicated construction.

SUMMARY OF THE INVENTION

According to the present invention, this object is achieved by a device for vertically forming partial stacks of printed products, which comprises a belt conveyor for transporting printed products, in particular in at least partially overlapped or scale-formed configuration; a bulging device, by which the printed products conveyed on the belt conveyor may be provided with a convexity around an axis extending in the conveying direction of the belt conveyor, a vertically extending collecting shaft, adjustable in format and disposed at one end of the belt conveyor in the extension thereof such that printed products conveyed on said belt conveyor drop into said collecting shaft, which has an openable stacking support disposed therein, on which a stack of printed products may be received, and a first supporting finger, disposed on the side of the belt conveyor facing away from the collecting shaft and above the stacking support, said finger being displaceable by a displacing device from a starting position, in which it extends centrally into the collecting shaft above the stream of printed products, vertically downwards into said stream of conveyed printed products, such that subsequently conveyed printed products are placed on said first supporting finger, which is then horizontally displaceable out of the collecting shaft such that the printed products placed thereon drop into said collecting shaft, and said finger being displaceable back into its starting position.

BRIEF DESCRIPTION OF THE DRAWINGS

The present invention will hereinafter be described in conjunction with the appended drawing figures, wherein.

DETAILED DESCRIPTION OF THE PREFERRED EMBODIMENT

Figure 1:
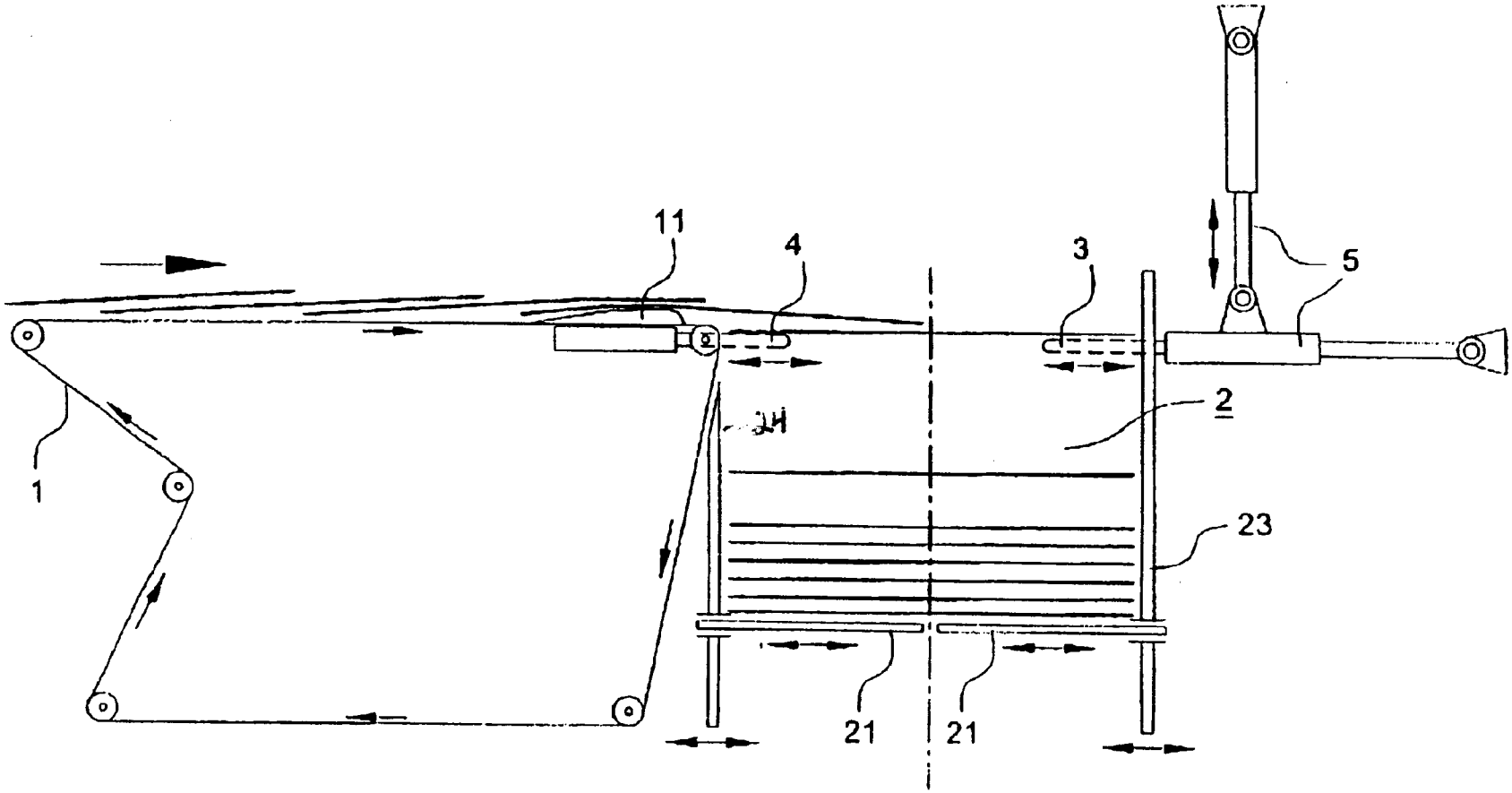
FIG. 1 shows a schematic elevational view of an embodiment of the device according to the invention.

As discussed herein, the formation of the convexity applies to the side of the printed products facing up during transport on the belt conveyor. Such a convexity around an axis extending in the conveying direction of the belt conveyor proposed according to the invention, i.e. a bulge formed such that the printed product bulges upwardly in the central region extending along the central line of the belt conveyor while hanging down in the lateral areas towards the edges of the belt conveyor, is also known as negative stabilisation.

A supporting finger in the context of the present invention is an element which does not occupy the entire width of the collecting shaft, but rather a smaller portion of the width, e.g. less than 50%, preferably less than 25%, particularly preferably less than 15%; the width being the horizontal extension of the collecting shaft perpendicular to the conveying direction of the belt conveyor.

The first supporting finger is said to be centrally extending into the collecting shaft, which means that it is disposed in the central region of its width, and which may not necessarily be exactly on the central plane, but may also be slightly off to the side thereof. According to the invention, it is also possible to provide several supporting fingers disposed in the central portion of the width.

A collecting shaft is said to be adjustable in format if the format of the cross-section of the collecting shaft, and thus the format of the printed products that may be stacked therein is variable; for example, it is continuously variable between A4 and B3.

Since, according to the invention, the first supporting finger is passed between two subsequent printed products by pushing it into the stream of printed products from above rather than laterally, there is no risk of malfunction even at high throughputs. When moving down into the stream from above, the displacement of the first supporting finger from where it first enters the conveying path of the printed products to the position where the printed products can be stably supported by the first supporting finger, is considerably shorter than when moving it laterally into the collecting shaft. Further, the movement of the individual printed products in the upper region of the collecting shaft is much more regular and thus less prone to malfunction. Further down inside the collecting shaft, the printed products are more likely to lie or move in a slanted or bulged fashion.

As the printed products are provided with a bulge or stabilisation, respectively, operation free from malfunction is ensured even for larger formats of printed products and larger format settings of the collecting shaft. For larger formats, the tip of the first supporting finger is spaced relatively far apart from the end of the belt conveyor. The printed products then have to cover a free distance towards the point where they are placed on the supporting finger. Without any stabilisation, the printed products would bend downwards and slide into the shaft in a slanted manner. This would make any action of the first supporting finger impossible.

Through the stabilisation by means of the bulge, the printed products extend across the free distance almost horizontally to the first supporting finger. By moving down onto the thus freely projecting 'scale', the first supporting finger is passed between consecutive printed products. By providing a negative stabilisation, i.e. a convexity, the printed products are made to still have sufficient stability once they have been placed on the first supporting finger. A concavity, i.e. a so-called positive stabilisation, would be disturbed by the leading end of the printed product being placed on the first supporting finger. Once placed on the first supporting finger, the printed product would be supported on the belt conveyor or on the first supporting finger by merely one of its two ends, but would not be supported in the middle. The concavity around an axis extending parallel to the conveying direction would change into concavity around a lateral axis due to the forces acting on it. In contrast thereto, a negative stabilisation by means of a convexity is maintained even after the printed product has been placed on the first supporting finger. The stream of printed products may thus be delayed in an orderly fashion and then started again.

By providing a supporting finger according to the invention, and not a supporting plate or separating plate, the constructional space and apparatus required for the displacement of the supporting device is small. The mass moved during displacement is small. Accordingly, a quick displacement is possible without requiring complicated equipment.

Preferably, the first supporting finger and the displacement device are formed such that, during its downward movement, the first supporting finger extends across virtually the entire length, i.e. the horizontal extension parallel to the conveying direction of the belt conveyor, of the collecting shaft, if the collecting shaft is set to the smallest selectable format in length. For example, a gap of 10 mm may still remain between the first supporting finger and the side of the collecting shaft facing the belt conveyor. It is thus possible to keep the free distance covered by the printed products from the belt conveyor to the first supporting finger as small as possible, even for larger formats within the format range.

According to the invention, it is possible to provide a displacement device which is variable in terms of the horizontal displacement distance of the first supporting finger. Thus, the free distance covered by the printed products may still be further reduced for large formats. However, the displacement device preferably provides a fixed displacement distance, of e.g. 150 mm or 200 mm. In this case, control of the displacement distance may be dispensed with. The displacement device may thus be considerably simpler in construction. For example, an unregulated hydraulic or pneumatic displacement device may be provided, thus eliminating the risk of collisions due to operating errors or malfunctions. Further, a displacement device without a controlled displacement distance may operate at a considerably higher displacement speed. Malfunctions caused by a too slow engagement of the first supporting finger in the scale stream may thus be eliminated as well. Moreover, this leads to a further increase in the achievable throughput.

According to the invention, it is possible that the format of the collecting shaft be adjustable at a small ratio. Preferably, the format of the collecting shaft is adjustable in such a way that, with regard to its format in the conveying direction of the belt conveyor, the ratio of the largest adjustable format to the smallest adjustable format is at least 2:1, preferably at least 3:1, more preferably at least 4:1. Only by the combination of a vertical introductory movement of the first supporting finger with a negative stabilisation of the printed products at the same time is it possible to realize such high adjustment ratios, without the equipment needs becoming unacceptable.

Preferably, the device additionally comprises a second supporting finger disposed above the stacking support on the side of the collecting shaft facing the belt conveyor, said finger being displaceable from a starting position outside of the collecting shaft to a position in which it extends centrally into the collecting shaft. With respect to the central disposition the same applies as in connection with the first supporting finger. It is possible to provide several supporting fingers disposed in the central region of the width.

The displacements of the first supporting finger and of the second supporting finger are synchronized with each other. For example, the second supporting finger may be displaced into the collecting shaft during the final phase of the downward movement. The second supporting finger is preferably displaced into the collecting shaft immediately upon the downward movement of the first supporting finger.

According to the invention, the bulging device may be realized e.g. by mechanically acting elements or by a fan. Preferably, the belt conveyor comprises two conveyor belts disposed side by side with a distance between them, and the bulging device comprises an upwardly protruding ramp at the end of the belt conveyor adjacent the collecting shaft between the conveyor belts. Thus, a simple mechanical element ensures that a convexity is very reliably formed in the printed products. In order to improve the bulging, e.g. further mechanical elements may be provided, such as elements pushing down the printed products in their lateral region while the latter are passing over the ramp.

Referring now to the drawings, FIG. 1 shows an embodiment of the device according to the invention for vertically forming partial stacks of printed products. Printed products can be conveyed on a horizontally moving belt conveyor 1.

The belt conveyor 1 has disposed in its immediate extension, at its end in the conveying direction, a vertically extending collecting shaft 2, so that printed products conveyed on the belt conveyor 1 drop into the collecting shaft 2. The cross-section of the collecting shaft 2 may be adjusted within a certain range to the same format as that of the respective printed products conveyed. As a consequence, the printed products dropping into the collecting shaft 2 form an orderly, laterally flush stack.

An openable stacking support 21, which extends horizontally through the collecting shaft 2, is disposed in the collecting shaft 2 a great distance below the upper end of the collecting shaft 2 below the conveying surface of the belt conveyor 1. The printed products dropping down form stacks on said stacking support 21. The stacking support 21 comprises two rake-shaped elements each extending from opposite side walls of the collecting shaft 2 towards the center of the collecting shaft 2. The stacking support 21 is openable by withdrawing the rake-shaped elements from the collecting shaft 2 in a horizontal direction by means of a driving device (not shown).

A first supporting finger 3, which is displaceable by a displacing device 5, is disposed above the stacking support 21, on the side of the collecting shaft 2 facing away from the belt conveyor 1. In a starting position, the first supporting finger 3 protrudes centrally into the collecting shaft 2 above the stream of printed products, thereby extending in a substantially horizontal direction. The first supporting finger 3 is displaceable by means of the pneumatically driven displacing device 5 in horizontal direction to and from the belt conveyor 1 as well as vertically displaceable. Thus, the first supporting finger 3 is displaceable downwards, at first, into the stream of conveyed printed products such that subsequently conveyed printed products are placed on top of the first supporting finger 3. The first supporting finger 3 is then displaceable out of the collecting shaft 2 in a horizontal direction, such that the printed products placed thereon drop into the collecting shaft 2, and is then displaceable back into its starting position.

As indicated by arrows in FIG. 1, the format of the collecting shaft 2 in its extension in the conveying direction of the belt conveyor 1 is adjustable by both the side wall 24 facing the belt conveyor and the side wall 23 facing away from the belt conveyor being movable. The two side walls 24, 23 are movable such that their plane of symmetry remains stationary. The belt conveyor 1 is movable in conjunction with the side wall 24 of the collecting shaft 2 facing the belt conveyor, so that the belt conveyor 1, regardless of the format selected, occupies the same position relative to the side wall 24 facing it. The displacing device 5 and the first supporting finger 3 supported by it are displaceable together with the side wall 23 facing away from the belt conveyor (not shown) such that the supporting finger 3, regardless of the format selected, occupies the same position. The displacing device 5 presents a defined, uniform displacement distance which is independent of the format selected.

As further shown in FIG. 1, said device comprises a second supporting finger 4 disposed on the side of the collecting shaft 2 facing the belt conveyor 1. The second supporting finger 4 extends horizontally in the conveying direction a short distance below the surface of the belt conveyor and is displaceable back and forth between a position outside of the collecting shaft 2 and a position where it extends centrally into the collecting shaft 2. The second supporting finger 4 serves to receive printed products together with the supporting finger 3 so as to briefly delay the scale-like stream of printed products, if larger formats are processed within the adjustable format range and the collecting shaft is set to these larger formats.

Figure 3A:
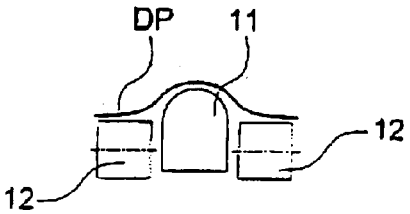
FIGS. 3A to 3C show a front view, a lateral view and a view from above of a bulging device according to one embodiment of the invention.
Figure 3B:
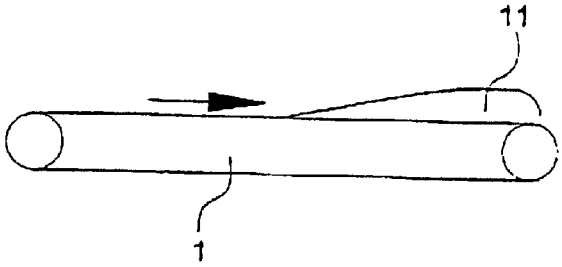
Figure 3C:
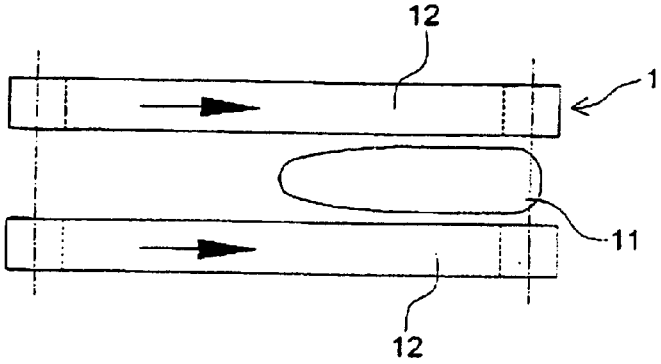

As shown in FIGS. 3A and 3C, the belt conveyor comprises two conveyor belts 12 disposed side by side at spaced apart positions. A bulging device 11 is provided between the conveyor belts 12, at the end of the belt conveyor 1 nearer to the collecting shaft 2. The bulging device 11 comprises a block extending upwardly from the plane of the belt conveyor surface. As shown in FIG. 3A, in a sectional plane perpendicular to the conveying direction of the belt conveyor 1, said block has a round, nearly semi-circular cross-section at its upper end. In elevation and as shown in FIG. 3B, the block has the shape of a ramp ascending towards the proximal end of the belt conveyor 1. As shown in FIG. 3A, wherein a printed product is designated as DP, the printed products, while being conveyed over the ramp, are provided with a convexity around an axis extending in the conveying direction of the belt conveyor 1.

As shown in FIG. 1, the printed products leaving the belt conveyor 1 and optionally placed on the first supporting finger 3 have to travel a free distance between the belt conveyor 1 or the second supporting finger 4 without any support. The negative stabilisation produced by means of the bulging device 11 prevents the printed products from bending downwards and from folding around an axis extending transversely of the conveying direction of the belt conveyor 1 and thus from dropping prematurely into the collecting shaft 2.

The mode of operation of the device according to one embodiment the invention is shown in FIGS. 2A to 2G. Each of said Figures shows a phase of a work cycle of the device, wherein only the belt conveyor 1, the collecting shaft 2 and the first supporting finger 3 are shown.

Figure 2A:
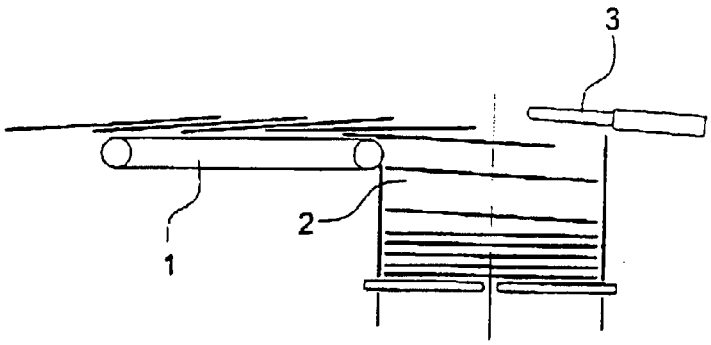
FIGS. 2A to 2G schematically show the mode of operation of an embodiment of the device according to the invention depicting individual phases of a work cycle.

FIG. 2A shows that the first supporting finger 3 is initially disposed above the stream of printed products being conveyed by the belt conveyor 1 and dropping into the collecting shaft 2.

Figure 2B:
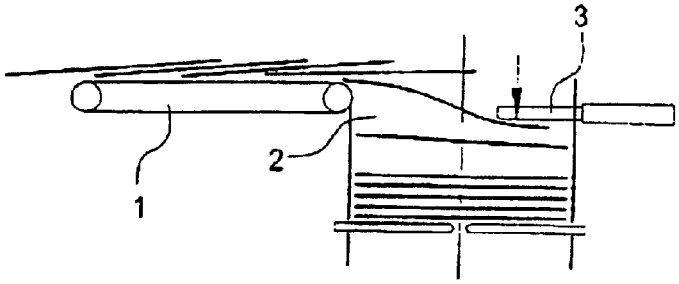

In FIG. 2B, the supporting finger 3 is displaced downwards into the stream, pushing down a printed product which has already been conveyed, for the most part, into the collecting shaft 2 by the belt conveyor 1. The subsequent printed product, however, is not gripped.

Figure 2C:
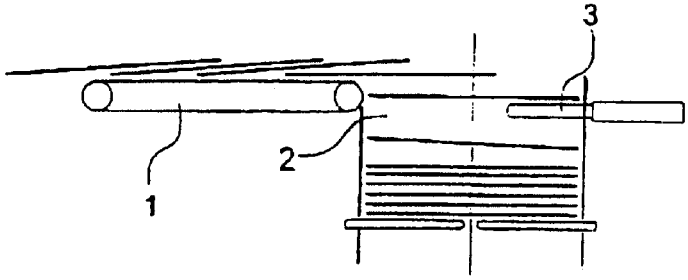

As shown in FIG. 2C, the printed product previously pushed down drops into the collecting shaft 2. The printed product which has not been gripped is placed on the first supporting finger 3, thus delaying the stream.

Figure 2D:
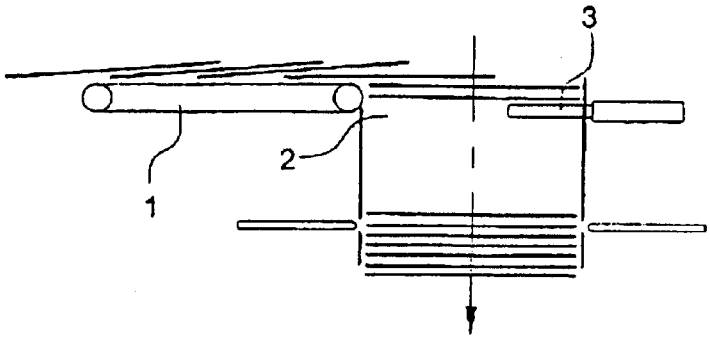

As shown in FIG. 2D, while further printed products are being placed on the first supporting finger 3, the stacking support 21 is opened and the stack formed upon it is ejected.

Figure 2E:
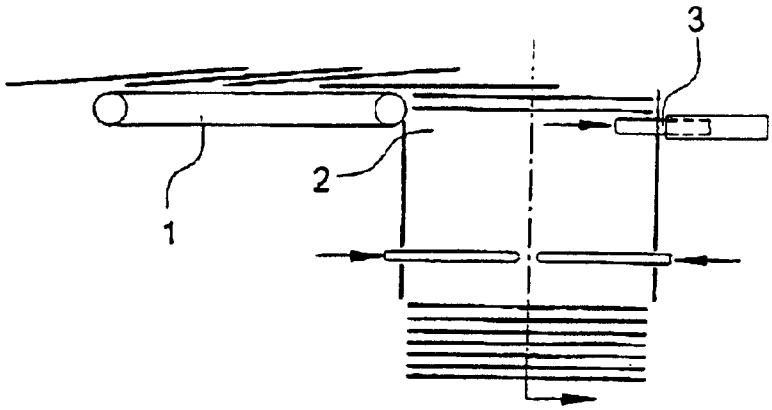

FIG. 2E shows that the stacking support 21 is then closed again. This is done without any problem, since the stream is still delayed.

Figure 2F:
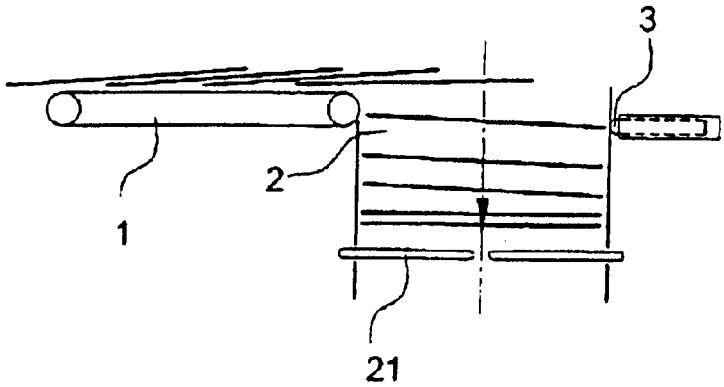

As shown in FIG. 2F, the first supporting finger 3 is withdrawn from the collecting shaft 2 in a horizontal direction. As a consequence, the printed products placed thereon drop into the collecting shaft 2. The first supporting finger 3 may also be withdrawn from the collecting shaft 2 a short time before the stacking support 21 is closed again. The closing of the stacking support 21 then has to be effected only before the printed products have dropped down as far as the stacking support 21.

Figure 2G:
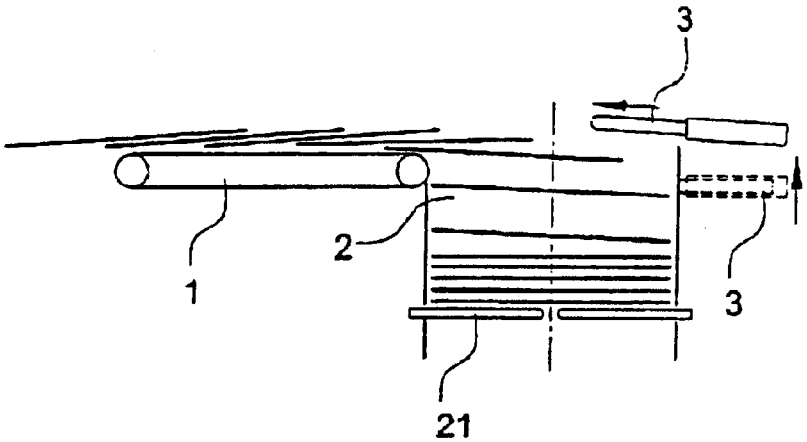

In FIG. 2G, the first supporting finger 3 is initially displaced vertically upwardly and then horizontally into the collecting shaft 2 and back into its starting position.

What is claimed is:

1. A device for vertically forming partial stacks of printed products, comprising:

a belt conveyor for transporting printed products, in scale-formed configuration, a stationery bulging device for providing the printed products conveyed on said belt conveyor with a convexity around an axis extending in the conveying direction of said belt conveyor, a vertically extending adjustable collecting shaft disposed at one end of said belt conveyor in the extension thereof such that printed products conveyed on said belt conveyor drop into said collecting shaft, said collecting shaft having an openable stacking support disposed therein to receive a stack of printed products, and a first supporting finger, disposed on the side of said belt conveyor facing away from said collecting shaft and above said stacking support, said finger being displaceable by a displacing device from a starting position, that extends centrally into said collecting shaft above a stream of printed products, vertically downwards into said stream of conveyed printed products, such that subsequently conveyed printed products are placed on said first supporting finger, which is then horizontally displaceable out of said collecting shaft such that said printed products placed thereon drop into said collecting shaft, said finger being further displaceable back into its starting position.

2. A device as claimed in claim 1, wherein said belt conveyor comprises two conveyor belts disposed side by side with a distance between them, and said bulging device comprises a ramp extending upwardly between said conveyor belts at an end of said belt conveyor adjacent to said collecting shaft.

3. A device as claimed in claim 1, wherein the format of said collecting shaft is adjustable such that, with respect to its format size in conveying direction of said belt conveyor, the ratio of its maximum format size to its smallest adjustable format size is at least 2:1.

4. A device as claimed in claim 3, wherein said belt conveyor comprises two conveyor belts disposed side by side with a distance between them, and said bulging device comprises a ramp extending upwardly between said conveyor belts at an end of said belt conveyor adjacent to said collecting shaft.

5. A device as claimed in claim 1, wherein the format of said collecting shaft is adjustable such that, with respect to its format size in conveying direction of said belt conveyor, the ratio of its maximum format size to its smallest adjustable format size is at least 3:1.

6. A device as claimed in claim 5, wherein said belt conveyor comprises two conveyor belts disposed side by side with a distance between them, and said bulging device comprises a ramp extending upwardly between said conveyor belts at an end of said belt conveyor adjacent to said collecting shaft.

7. A device as claimed in claim 1, wherein the format of said collecting shaft is adjustable such that, with respect to its format size in conveying direction of said belt conveyor, the ratio of its maximum format size to its smallest adjustable format size is at least 4:1.

8. A device as claimed in claim 7, wherein said belt conveyor comprises two conveyor belts disposed side by side with a distance between them, and said bulging device comprises a ramp extending upwardly between said conveyor belts at an end of said belt conveyor adjacent to said collecting shaft.

9. A device as claimed in claim 1, further comprising a second supporting finger, disposed on a side of said collecting shaft facing said belt conveyor and above said upper stacking support, said finger being displaceable from a starting position outside of said collecting shaft to a position in which it extends substantially centrally into said collecting shaft.

10. A device as claimed in claim 9, wherein said belt conveyor comprises two conveyor belts disposed side by side with a distance between them, and said bulging device comprises a ramp extending upwardly between said conveyor belts at an end of said belt conveyor adjacent to said collecting shaft.

11. A device as claimed in claim 1, wherein said displacing device has a defined displacement distance.

12. A device as claimed in claim 11, wherein the format of said collecting shaft is adjustable such that, with respect to its format size in conveying direction of said belt conveyor, the ratio of its maximum format size to its smallest adjustable format size is at least 2:1.

13. A device as claimed in claim 12, wherein said belt conveyor comprises two conveyor belts disposed side by side with a distance between them, and said bulging device comprises a ramp extending upwardly between said conveyor belts at an end of said belt conveyor adjacent to said collecting shaft.

14. A device as claimed in claim 11, wherein the format of said collecting shaft is adjustable such that, with respect to its format size in conveying direction of said belt conveyor, the ratio of its maximum format size to its smallest adjustable format size is at least 3:1.

15. A device as claimed in claim 14, wherein said belt conveyor comprises two conveyor belts disposed side by side with a distance between them, and said bulging device comprises a ramp extending upwardly between said conveyor belts at an end of said belt conveyor adjacent to said collecting shaft.

16. A device as claimed in claim 11, wherein the format of said collecting shaft is adjustable such that, with respect to its format size in conveying direction of said belt conveyor, the ratio of its maximum format size to its smallest adjustable format size is at least 4:1.

17. A device as claimed in claim 16, wherein said belt conveyor comprises two conveyor belts disposed side by side with a distance between them, and said bulging device comprises a ramp extending upwardly between said conveyor belts at an end of said belt conveyor adjacent to said collecting shaft.

18. A device as claimed in claim 11, further comprising a second supporting finger disposed on a side of said collecting shaft facing said belt conveyor and above said upper stacking support, said finger being displaceable from a starting position outside of said collecting shaft to a position in which it extends substantially centrally into said collecting shaft.

19. A device as claimed in claim 18, wherein said belt conveyor comprises two conveyor belts disposed side by side with a distance between them, and said bulging device comprises a ramp extending upwardly between said conveyor belts at an end of said belt conveyor adjacent to said collecting shaft.

20. A device as claimed in claim 11, wherein said belt conveyor comprises two conveyor belts disposed side by side with a distance between them, and said bulging device comprises a ramp extending upwardly between said conveyor belts at an end of said belt conveyor adjacent to said collecting shaft.

* * * * *

UNITED STATES PATENT AND TRADEMARK OFFICE

CERTIFICATE OF CORRECTION

PATENT NO. : 6,446,962 B1
DATED : September 10, 2002
INVENTOR(S) : Michael Taffertshofer It is certified that error appears in the above-identified patent and that said Letters Patent is hereby corrected as shown below:

Title page,
Item [56], References Cited, FOREIGN PATENT DOCUMENTS,
Replace "93 17 919" with -- 93 17 919.7 --.
Delete "4408780" as it is a duplicate.

Column 7,
Line 33, replace "stationery" with -- stationary --.

Signed and Sealed this

Fourteenth Day of January, 2003

JAMES E. ROGAN
*Director of the United States Patent and Trademark Office*